US007524168B2

(12) United States Patent
Tschuor et al.

(10) Patent No.: US 7,524,168 B2
(45) Date of Patent: Apr. 28, 2009

(54) ARRANGEMENT FOR THE ADMISSION OF COOLING AIR TO A ROTATING COMPONENT, IN PARTICULAR FOR A MOVING BLADE IN A ROTARY MACHINE

(75) Inventors: Remigi Tschuor, Windisch (CH); Heinz Neuhoff, Waldshut-Tiengen (DE); Iouri Strelkov, Moscow (RU)

(73) Assignee: Alstom Technology Ltd, Baden (CH)

( * ) Notice: Subject to any disclaimer, the term of this patent is extended or adjusted under 35 U.S.C. 154(b) by 189 days.

(21) Appl. No.: 11/528,257

(22) Filed: Sep. 28, 2006

(65) Prior Publication Data

US 2007/0041836 A1 Feb. 22, 2007

Related U.S. Application Data

(63) Continuation of application No. PCT/EP2005/051411, filed on Mar. 29, 2005.

(30) Foreign Application Priority Data

Mar. 30, 2004 (DE) ..... 10 2004 015 609

(51) Int. Cl.
*F01D 5/08* (2006.01)

(52) U.S. Cl. ..... 416/97 R; 416/248

(58) Field of Classification Search ..... 416/96 R, 416/97 R, 248
See application file for complete search history.

(56) References Cited

U.S. PATENT DOCUMENTS 2,819,870 A * 1/1958 Wayne ..... 416/248
2,830,357 A * 4/1958 Blackwell et al. ..... 29/889.721
3,834,831 A * 9/1974 Mitchell ..... 416/95
3,902,820 A * 9/1975 Amos ..... 416/97 R
3,989,412 A * 11/1976 Mukherjee ..... 416/97 R
4,236,870 A * 12/1980 Hucul et al. ..... 416/97 R (Continued)

FOREIGN PATENT DOCUMENTS

DE 10 2004 011 151 A1 9/2004

(Continued)

*Primary Examiner*—Edward Look
*Assistant Examiner*—Aaron R Eastman
(74) *Attorney, Agent, or Firm*—Buchanan Ingersoll & Rooney PC

(57) ABSTRACT

An arrangement is disclosed for the admission of cooling air to the internal walls of a component rotating about a rotation axis, such as a moving blade in a rotary machine. A component root can be fastened to a rotor unit in a rotationally fixed manner and adjoining in a radially extending manner is a one piece component airfoil in which at least one radially extending cooling passage region (K1) is provided which, in the region of the component root, opens out via an opening into a cooling-air supply passage passing at least partly through the component root longitudinally relative to the rotation axis. A distribution plate forms a fluid-tight connection with an opening margin, surrounding the opening of the cooling passage region (K1), at least during the rotation of the component about the rotation axis. The distribution plate provides at least one through-opening in the region of the opening of the at least one cooling passage region (K1), through which through-opening cooling air passes from the axial cooling-air supply passage into the radial cooling passage region (K1).

20 Claims, 5 Drawing Sheets

U.S. PATENT DOCUMENTS

| | | | | |
|---|---|---|---|---|
| 4,626,169 | A * | 12/1986 | Hsing et al. | 416/95 |
| 6,981,845 | B2 * | 1/2006 | Balland et al. | 416/96 R |
| 2002/0028140 | A1 * | 3/2002 | Jacala | 416/96 R |
| 2002/0150474 | A1 * | 10/2002 | Balkcum et al. | 416/97 R |

FOREIGN PATENT DOCUMENTS

| | | | |
|---|---|---|---|
| DE | 102004011151 | A1 * | 9/2004 |
| EP | 0 340 149 | A1 | 11/1989 |
| GB | 1 605 282 | | 12/1987 |
| GB | 1605282 | * | 12/1987 |
| WO | WO 9947792 | A1 * | 9/1999 |
| WO | WO 02/086291 | A1 | 10/2002 |

* cited by examiner

ARRANGEMENT FOR THE ADMISSION OF COOLING AIR TO A ROTATING COMPONENT, IN PARTICULAR FOR A MOVING BLADE IN A ROTARY MACHINE

RELATED APPLICATION

This application is based on and claims priority under 35 U.S.C. §119 to German Application No. 10 2004 015 609.3, filed Mar. 30, 2004 and is a continuation application under 35 U.S.C. §120 of International Application No. PCT/EP2005/051411, filed Mar. 29, 2005 designating the U.S., the entire contents of both of which are hereby incorporated by reference.

BACKGROUND

Rotary machines, for example turbo or compressor stages of gas or steam turbine plants, for the specific expansion or compression of gases or gas mixtures, generally have fixed guide blades and moving blades rotating about a rotation axis. The blades can be exposed to high process temperatures and therefore may have to withstand high thermal loads. In addition to the thermal load, the moving blades in particular, rotating about the rotation axis, may additionally be subjected to high mechanical loads caused by the centrifugal forces.

In the attempt to improve the efficiency of such heat engines, measures can be taken which result in the rotating components being subjected to ever increasing thermal and mechanical loads on account of increasing process temperatures and increased rotary speeds. However, these attempts can be subject to physical load limits on account of the materials used, from which in particular the rotating plant components can be produced. To optimize the efficiency even further, ways of effectively cooling the plant components exposed to heat and subjected to centrifugal force are looked for. To this end, a number of proposals with which cooling air is admitted to moving blades in rotary machines are already known. Typically, a moving blade of such a design, in order to fasten it to the rotor, has a moving blade root which is structured like a fir tree stem, and the moving blade airfoil radially adjoins this moving blade root. For cooling purposes, a multiplicity of radially oriented cooling passages can pass through the moving blade root, these cooling passages, for the effective cooling of the moving blade, extending along the inner walls through the entire moving blade airfoil. Cooling-air feed passages provided on the rotor serve to feed cooling air, which is fed into the cooling passages passing radially through the moving blade root. Such a cooling-air supply system therefore includes a rotor which has a multiplicity of radially oriented cooling-air passages and whose individual cooling passages, by appropriate positioning of the individual moving blades, can be brought exactly into alignment with the radial cooling passages provided in the moving blade root. Even the slightest maladjustments between moving blade root and rotor unit may permanently impair effective cooling of the moving blade, thereby considerably reducing the service life of the moving blade.

As an alternative to radially supplying a moving blade with cooling air via a rotor-side cooling-air supply system, it has been proposed to effect the cooling-air supply via a cooling-air supply passage passed axially through the moving blade root. In this case, the cooling-air feed flow passes into the axially oriented cooling-air supply passage inside the moving blade root, branching off from which are individual cooling-air passages projecting radially into the moving blade root. Since moving blades are generally produced by a casting process, the "core technique" is used for forming such cavities inside a cast part, this core technique in particular enabling the cooling-air supply passage passing axially through the moving blade root and the individual cooling passages passing radially at least partly through the inside of the moving blade airfoil to be produced. However, it has been found that flow baffles have to be provided inside the axially oriented cooling-air supply passage for optimized distribution of the cooling-air feed flow, these flow baffles being intended to deflect the axially directed cooling-air feed flow into the radially extending cooling passages inside the moving blade root. However, for production reasons, the flow baffles which are to be provided for this purpose and which both change the direction of and distribute the cooling-air feed flow axially directed into the blade root can be subject to production-related structural shape tolerances, which reduce the accuracy with which the cooling-air flow can be directed and distributed to the individual cooling passages extending radially along the moving blade airfoil.

SUMMARY

Exemplary embodiments disclosed herein optimize the cooling-air distribution to the individual radially oriented cooling passages inside a moving blade. The measures to be taken for this purpose can avoid costly production or assembly steps and can have robust properties which are able to cope with the high demands with regard to thermal and also mechanical loads within such components rotating about a rotation axis.

An arrangement is disclosed for the admission of cooling air to the internal walls of a component rotating about a rotation axis, in particular a moving blade in a rotary machine, such as a gas turbine plant for example, having a component root which can be fastened to a rotor unit in a rotationally fixed manner and adjoining which in one piece in a radially extending manner is a component airfoil in which at least one radially extending cooling passage region is provided which, in the region of the component root, opens out via a respective opening into a cooling-air supply passage passing at least partly through the component root longitudinally relative to the rotation axis, is developed in such a way that a distribution plate is provided in the region of the cooling-air supply passage in such a way that the distribution plate forms a fluid-tight connection with an opening margin, surrounding the opening of the cooling passage region, at least during the rotation of the component about the rotation axis. Furthermore, the distribution plate provides at least one through-opening in the region of the opening of the at least one cooling passage region, through which through-opening cooling air passes from the axial cooling-air supply passage into the radial cooling passage region.

In order to depict and describe exemplary embodiments in a simpler manner, the further explanations relate to the case of a moving blade which is fitted along a rotor unit of a gas or steam turbine plant and can be inserted into a turbo stage or compressor stage. Of course, this reference is not to restrict the general ideas described herein, which also relate to alternative plant components which are subjected to comparable loads.

The distribution plate, which can be produced from a temperature-resistant flat material, provides through-openings along its extent in each case in such a way as to correspond to the radially extending cooling passage regions, the through-openings each having opening diameters which can predetermine the volumetric flow of cooling air which passes into the individual cooling passage regions. The distribution plate therefore enables volumetric proportions of cooling air, which are calculated beforehand and are adapted to the respective rotating moving blade, to be distributed to the individual radially extending cooling passage regions. On account of the production tolerances unavoidably associated with the casting process, such an exact distribution of the cooling-air flow is not possible solely by using flow baffles produced by casting.

In order to keep the assembly cost for incorporating the distribution plate along the cooling supply passage extending axially through the component root as low as possible, and in order to exactly position the distribution plate relative to the at least one radially extending cooling passage region, at least two axially spaced-apart shoulder elements are provided inside the cooling-air supply passage, and these shoulder elements are located radially opposite the opening margin of the opening of the at least one cooling passage region and at a slight distance from this opening margin and define together with the latter a push-in slot, in which the distribution plate preferably fits snugly in a flush manner by being pushed axially into the cooling-air supply passage. At this point, it may be noted that a plurality of cooling passage regions passing radially through the moving blade root can be provided, these cooling passage regions being arranged in such a way as to be separated from one another by intermediate walls. Via a respective opening margin which is oriented so as to face the cooling-air supply passage extending in the moving blade root and encloses the opening of the respective radially extending cooling passage region, the intermediate walls open out in the region of said cooling-air supply passage. According to an exemplary embodiment, with this opening margin, a fluid-tight connection can be provided relative to the distribution plate, at least in the rotation state, in order to completely rule out possible leakage flows between distribution plate and opening margin.

To this end, the distribution plate can advantageously rest loosely between the shoulder elements and the at least one opening margin, so that the distribution plate is pressed radially outward against the opening margin by the centrifugal forces produced by the rotation and forms the desired fluid-tight connection with said opening margin, as a result of which any axially directed leakage flows between distribution plate and the opening margin are effectively prevented.

Due to the fluid-tight connection, produced automatically by the rotation, between the distribution plate and the opening margin of the opening of the at least one radially extending cooling passage region, it is not necessary to provide tolerance-free gap sizes for the push-in slot which is defined between the shoulder elements and the at least one opening margin, a requirement which cannot be met anyway by conventional casting processes.

In order to provide for ensuring a fluid-tight connection between the distribution plate and the corresponding opening margins, at least during rotation, the distribution plate can be produced from such a material and with such a material thickness that the bending moment of the distribution plate is exceeded due to the centrifugal forces produced by the rotation and acting on the distribution plate, and the distribution plate is able to correctly conform to the casting geometry of the opening margins. In addition, in a further exemplary embodiment, this conformity action is assisted by the distribution plate having locally limited material weak points, for example in the form of mechanical notches or cracks. Such material weak points can also be produced by specifically changing the structure in the distribution plate. Such points of reduced strength are arranged in a distributed manner along the distribution plate, for example, in regions close to the opening margins where it may be desired to produce a fluid-tight connection.

It may also be advantageous in some cases to fixedly join the distribution plate to the inner structure of the moving blade root in the region of the cooling-air supply passage at least at the ends—at one end or at both ends—by a brazed or welded joint. The joint locations required for this are easily accessible axially through the cooling-air supply passage for assembly purposes, so that the assembly cost necessary for this is not substantially increased.

Since the cooling-air supply extending axially completely through the moving blade root is designed to be open on both sides with regard to the moving blade root, as will be explained in more detail below with reference to an exemplary embodiment, it is necessary to close the axial opening in a fluid-tight manner.

A very simple embodiment provides for an end closure of the cooling-air supply passage to be created by appropriately bending over an end region of the distribution plate, and to weld or braze the distribution plate to the inner wall of the cooling-air supply passage at least in the region of its plate section bent over at the end. However, fixing in this respect could have an adverse effect on the required fluid-tight connection, produced at least in the rotation state, between the distribution plate and the at least one opening margin, so that a further preferred embodiment, instead of fixedly joining the distribution plate in the region of the bent-over distribution plate section, provides a separate closing plate which axially closes off the cooling-air supply passage in a fluid-tight manner on one side. It is suitable for this purpose for the closing plate, adapted to the cross-sectional contour of the cooling-air supply passage, to be joined to the moving blade root in a fluid-tight manner via brazed or welded joints.

BRIEF DESCRIPTION OF THE DRAWINGS

Exemplary embodiments are explained below, without restricting the general idea, with reference to the drawings, in which.

DETAILED DESCRIPTION

Figure 1:
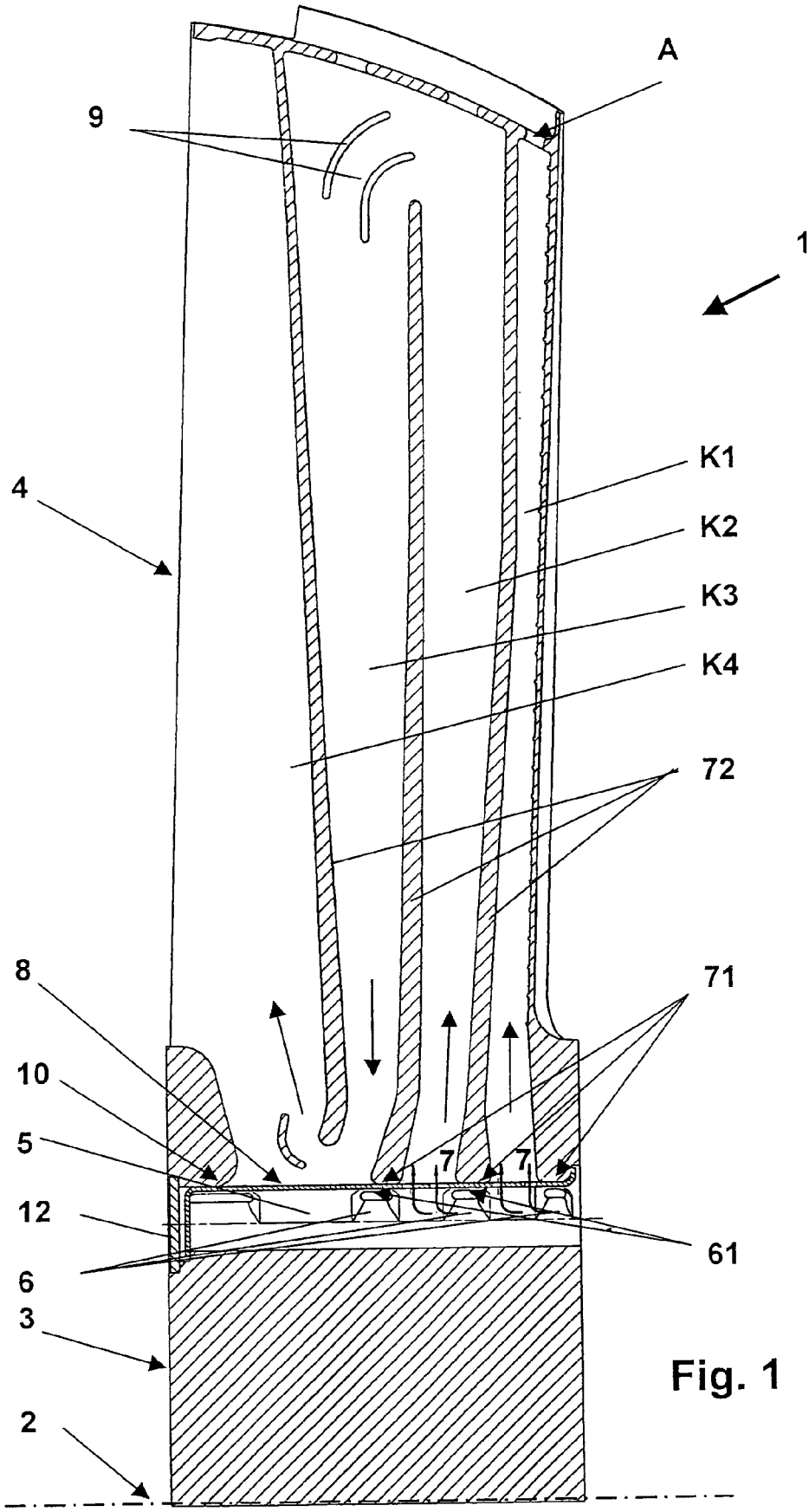
FIG. 1 shows a cross section through an exemplary moving blade of a gas turbine plant.

Shown in FIG. 1 is the cross section through an exemplary moving blade 1, which is rotatable about a rotation axis 2 of a rotor unit integrated in a gas turbine arrangement. The moving blade 1 has a moving blade root 3, which can be frictionally connected to the rotor unit (not shown in any more detail) via an appropriately designed joining contour (fir-tree structure—not shown). Radially adjoining the moving blade root 3 is the moving blade airfoil 4, in the interior of which cooling passage regions K1 to K4 are provided. Extending in the region of the moving blade root 3 is a cooling-air supply passage 5 which is oriented axially, i.e. parallel to the rotation axis 2, and passes first of all through the entire axial width of the blade root 3. Provided in the interior of the cooling-air supply passage 5 are "shoulder elements" 6 which, by the casting process with which the entire moving blade 1 can be produced, are fashioned from the casting material from which the rest of the moving blade is made. The shoulder elements 6 have top surface sections 61, which are radially opposite and at a slight distance from "opening margins" 71. The opening margins 71 surround openings 7 facing the cooling-air supply passage 5, and radially adjoining these openings 7 are the cooling passage regions K1 and K2, which are each defined by cooling passage wall regions 72. Like the cooling-air supply passage 5, the cooling passage regions K1 to K4 provided in the interior of the moving blade airfoil can also be produced by the casting process by providing a suitably modeled displacement core, which serves as a spacer for the respective cavities and is inserted in the casting mold during the casting process.

A distribution plate 8 in which appropriately positioned and dimensioned through-openings 81 are incorporated is provided in order to direct, but in particular in order to proportion, the cooling-air flow passing through the cooling passage regions K1, K2, K3 and K4. The through-openings 81 are correspondingly provided in the orifice region of the openings 7.

In the exemplary embodiment shown according to FIG. 1, the cooling-air feed flow is supplied axially via the cooling-air supply passage 5 to be fed specifically into the cooling passage regions K1 and K2. The through-openings 81 provided in the orifice region of the cooling passage region K1 permit a cooling-air flow radially through the cooling passage K1, which provides an outlet opening A at the top flank of the moving blade airfoil 4, through which outlet opening A the cooling air escapes into the hot-gas passage H. In contrast, the cooling air entering the cooling passage region K2 via the through-openings 81 is for the most part diverted by appropriate flow baffles 9 into the cooling passage region K3, adjoining which in the direction of flow (see flow arrows) is the cooling passage region K4. In the connecting region between the cooling passage regions K3 and K4, the distribution plate 8 provides for the cooling-air flow flowing downward in the cooling passage region K3 to be deflected entirely into the cooling passage region K4 extending radially upward. For this purpose, the distribution plate 8 conforms to the corresponding opening margins 71 and the marginal contour 10 in a gas- or fluid-tight manner. At the same time, no leakage flows occur between the distribution plate 8 and the opening margins 71. In order to ensure this, dimensions of the distribution plate 8 and its material are selected in such a way that it is pressed firmly against the corresponding opening margins 71 and the marginal contour 10 in a fluid-tight and flush manner by the centrifugal forces caused by the rotation about the rotation axis 2. In this case, the distribution plate 8 lies loosely in the inlet slot 11 defined between the surface sections 61 of the shoulder elements 6 and the opening margins 71 and the marginal contour 10 (see FIG. 2).

A closing plate 12 which is fixedly joined to the moving blade root 3 by a welded or brazed joint provides for an axial, gas-tight closure of the cooling-air supply passage 5 on one side.

Figure 2:
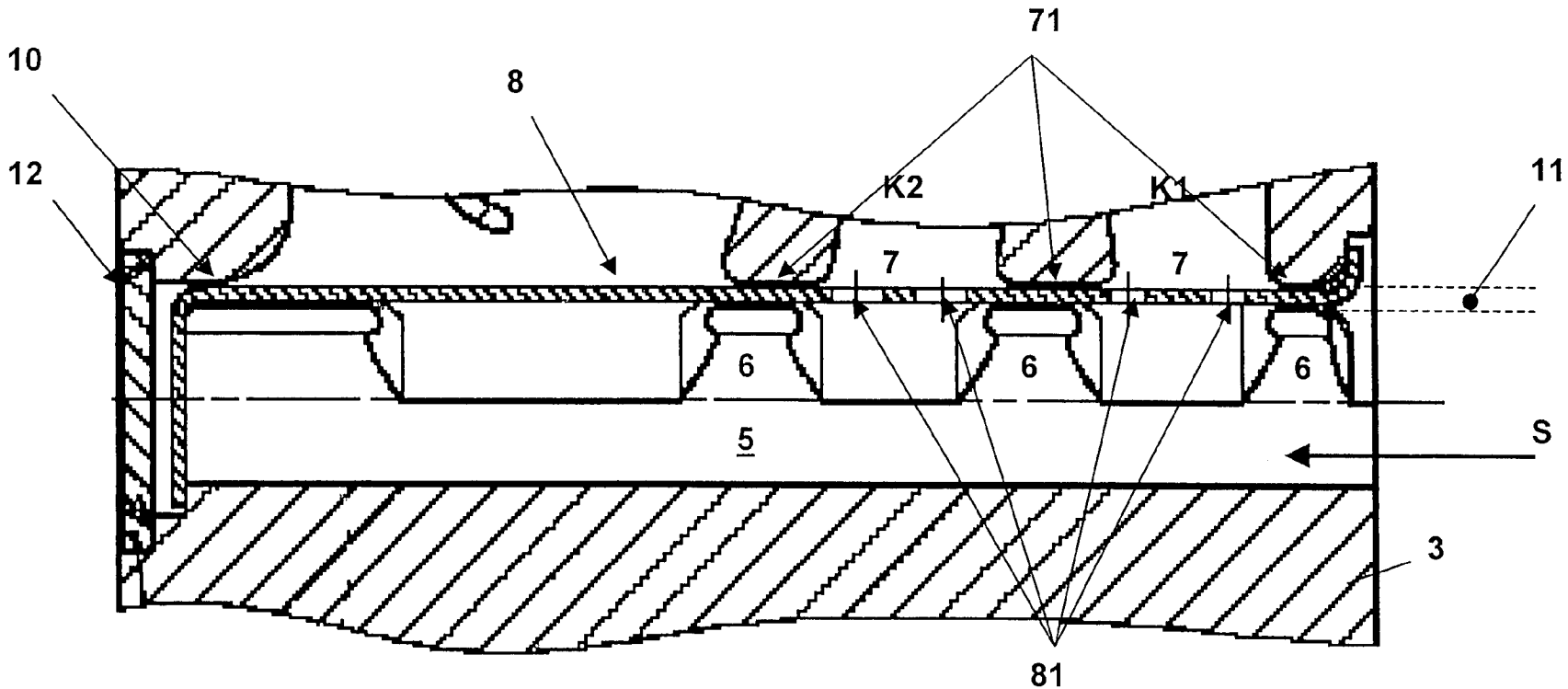
FIG. 2 shows a detailed cross-sectional illustration through the root region of an exemplary moving blade.

FIG. 2 shows a detailed illustration of the exemplary distribution plate 8 inserted into the axially extending cooling-air supply passage 5. As already mentioned, the shoulder elements 6 present in the interior of the cooling-air supply passage 5 and also the individual cooling passage regions K1 to K4, i.e. the cooling passage wall regions 72 with the corresponding opening margins 71, are jointly produced by the casting process. The opening margins 71 enclose with the surface sections 61 of the shoulder elements 6 a push-in slot 11, along which the distribution plate 8, which is formed with a plane surface in the initial state, can be pushed in axially. After the distribution plate 8 in the form shown in figure 2 has been pushed into position inside the cooling-air supply passage 5, the end regions of the distribution plate 8 are bent over in the manner indicated in figure 2 in order to largely fix the distribution plate 8 axially and radially inside the push-in slot 11. Otherwise, the distribution plate 8 still rests loosely on the surface sections 61 of the shoulder elements 6. In order to axially close off the cooling-air supply passage 5 on one side in a fluid-tight manner, a closing plate 12 is inserted into the cooling-air supply passage 5 at the left-hand inlet opening in figure 2 and is welded or brazed to the moving blade root 3 in marginal regions. Due to the gas-tight closure of the cooling-air supply passage 5 on one side, the cooling-air feed flow S entering the cooling-air supply passage 5 from the right-hand side is subjected to a baffle effect forming inside the cooling-air supply passage 5, as a result of which the cooling-air feed flow S is driven through the through-openings 81 provided in the distribution plate 8. The size and arrangement of the individual through-openings 81 define the volumetric flow of the cooling-air flow entering the respective cooling passage regions K1 and K2. Due to the intimate fluid-tight connection, forming during the rotation, between the distribution plate 8 and the opening margins 71 which surround the respective openings 7 of the cooling passage regions K1 and K2, any leakage flows which could form between the distribution plate 8 and the opening margins 71 can be prevented. This ensures that the cooling-air flow is directed free of losses solely along the cooling passage regions K1 to K4 provided in the interior of the moving blade airfoil.

Figure 3:
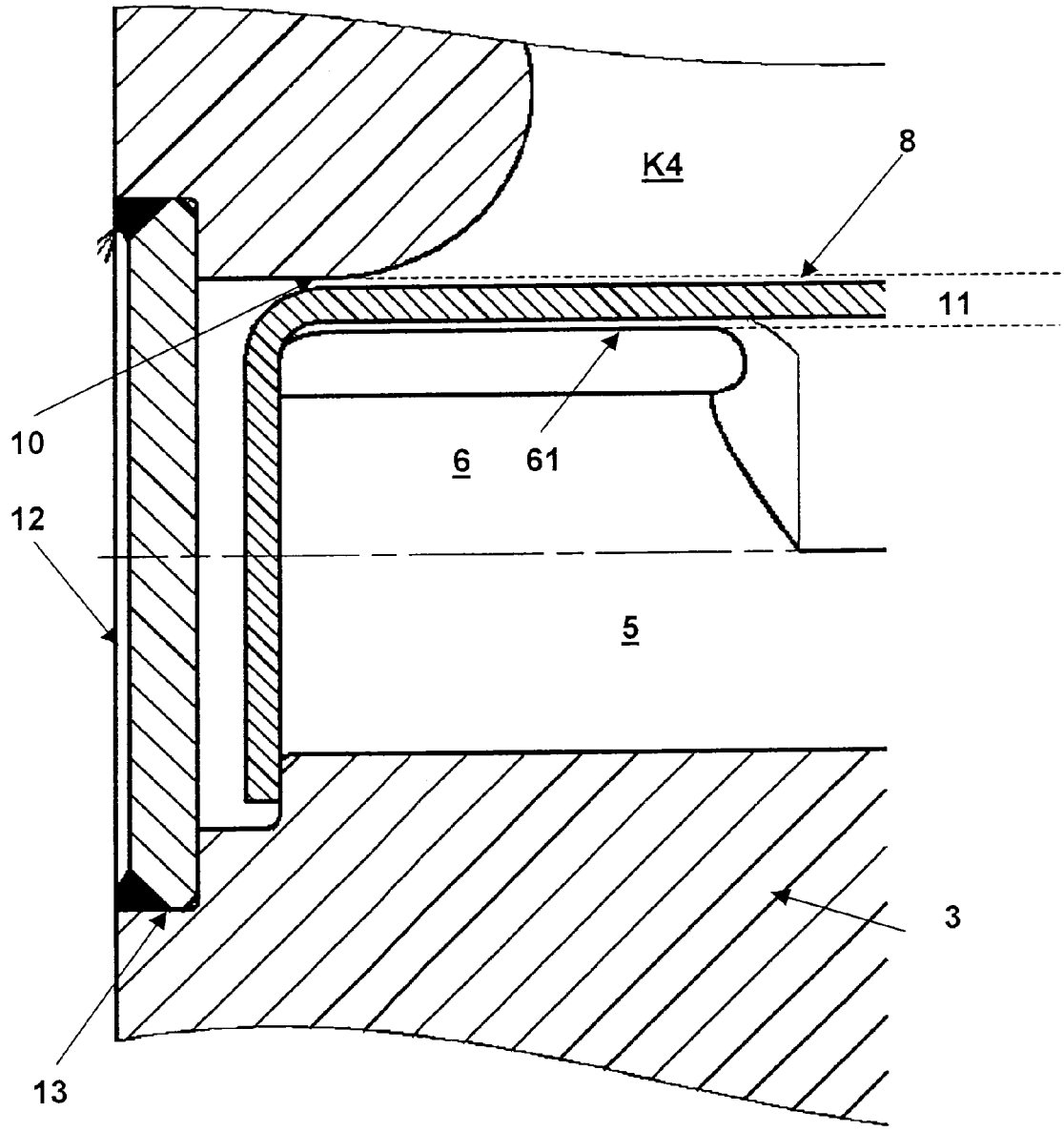
FIG. 3 shows a detailed illustration of an exemplary closing plate which axially closes off the cooling-air supply passage in a gas-tight manner.

FIG. 3 shows a further detailed illustration of the exemplary closing plate 12 welded to the axial end region of the cooling-air supply passage 5 in a fluid-tight manner. The closing plate 12 sits in a recess 13 of corresponding matching contour inside the moving blade root 3 and is welded to the latter in a fluid-tight manner. It can also be seen from FIG. 3 that the distribution plate 8 rests loosely on the shoulder element 6 inside the push-in slot 11. It is only by means of the rotation and the resulting centrifugal forces that the distribution plate 8 is lifted radially and thus comes into contact with the marginal contour 10, with which it forms a correspondingly fluid-tight connection. This avoids a situation where cooling air can pass back into the cooling-air supply passage 5 from the cooling passage region K4 at this point.

Figure 4:
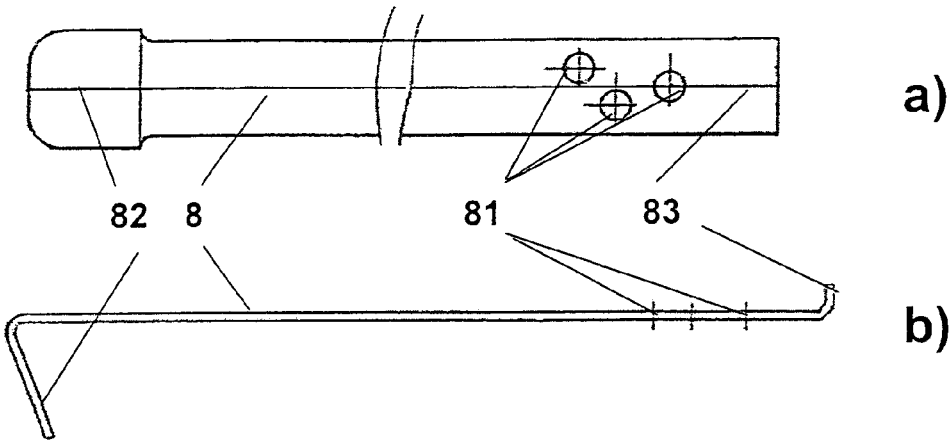
FIGS. 4*a-d* show views of exemplary distribution plates of alternative design.
Figure 4:
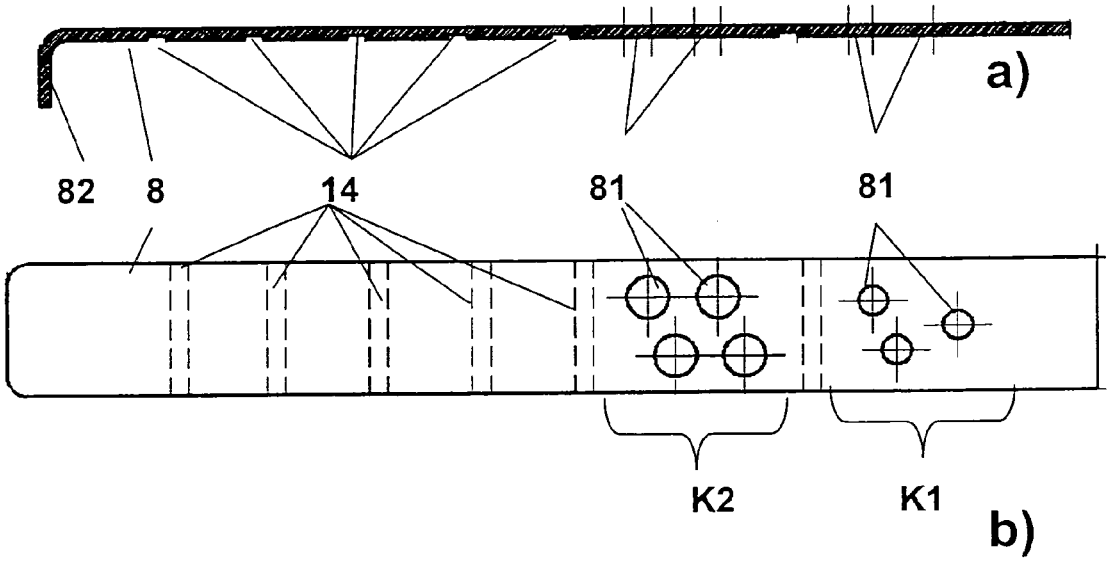

FIGS. 4*a-d* show two different respective embodiments for a distribution plate 8. FIGS. 4*a* and *b* show a plan view and side view of a first distribution plate 8, the geometrical dimensions of which are adapted to the push-in slot 11 described above. The distribution plate 8 is produced from a heat-resistant flat material and, for fitting purposes, is first of all of plane design on one side (see FIG. 4*a*). Furthermore, the distribution plate 8 has through-openings 81, the arrangement, shape and size of which determines the cooling-air volume which is delivered through the cooling passage regions K1 to K4.

For fitting purposes, the distribution plate 8 of plane design on one side can be pushed in axially between the opening margins 71 and the surface sections 61 of the shoulder elements 6 and can be appropriately bent over in the manner described above at an end section 82 or 83 after it has been completely inserted into the cooling-air supply passage 5. In this respect, see the side view in FIG. 4*b*. As already mentioned at the beginning, the dimensions of the distribution plate 8 and the material are selected in such a way that at least local deflections can occur on the distribution plate 8 in the region of the opening margins 71, so that the distribution plate 8 can form a fluid-tight connection with the opening margins 71. In order to improve the bendability of the distribution plate 8, in particular in regions which are opposite the opening margins 71, local material weak points in the form of notches 14 are provided along the distribution plate 8 according to the exemplary embodiment in FIGS. 4*c* and *d*. Due to the deliberate provision of the locally limited notches 14, the bending stiffness of the distribution plate 8 can be reduced at least locally, in order to optimize local conformity of the distribution plate 8 to the opening margins 71. Likewise, the exemplary embodiment in FIGS. 4*c* and 4*d* provides through-openings 81 of different dimensions in each case for the cooling-air feed into the cooling passage sections K1 and K2. Thus substantially less cooling air is admitted to the cooling passage region K1 than to the cooling passage region K2.

The measures described above serve the loose mounting of the distribution plate 8 inside the cooling-air supply passage 5, the distribution plate 8 being spatially fixed merely inside the push-in slot 11 on the one hand by the shoulder elements 6 and on the other hand by the opening margins 71 or respectively the marginal contour 10. In this way, welding operations which are complicated in terms of assembly can be completely avoided, but may be locally provided if required.

Figure 5:
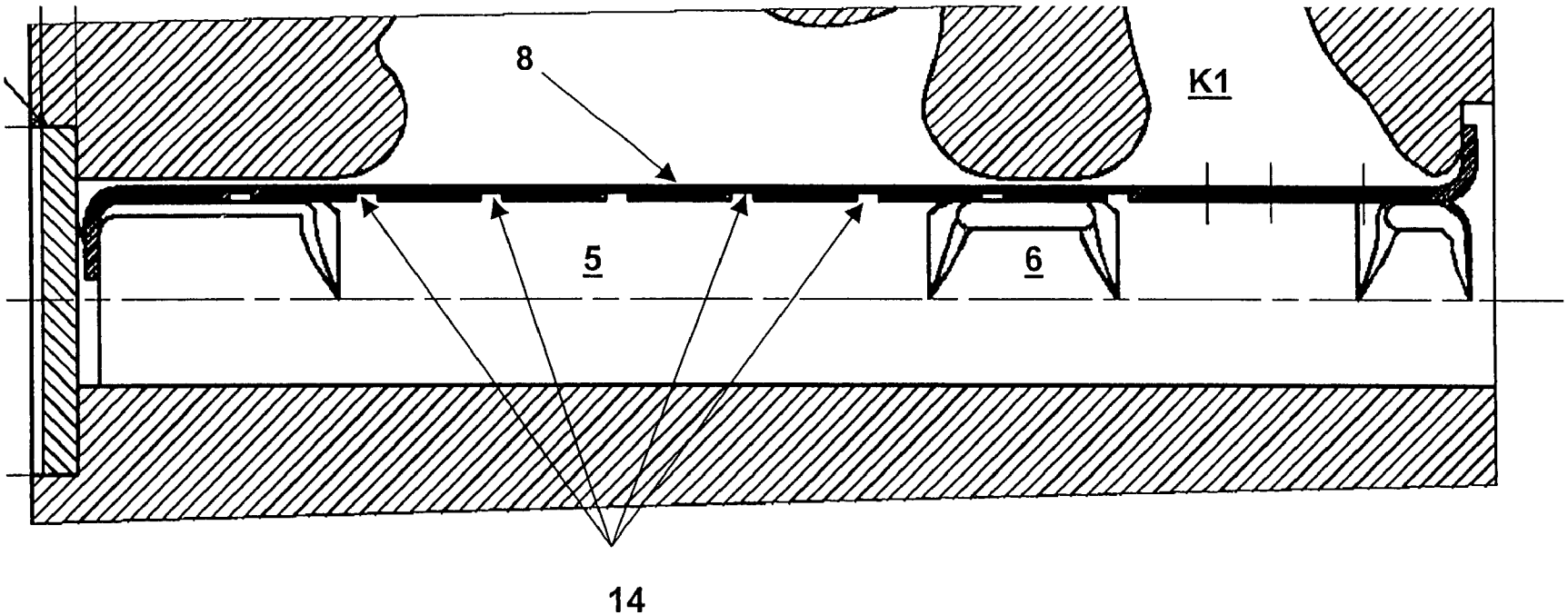
FIG. 5 shows an alternative exemplary distribution plate inside a moving blade root.

FIG. 5 shows a partial cross section through the root region 3 of a moving blade 1 which is designed in accordance with the above explanations. Provided along the cooling-air supply passage 5 is a single cooling passage region K1, into which cooling air is to be specifically branched off from the cooling-air supply passage 5. This is effected via appropriately provided through-openings in the axially inserted distribution plate 8, which has notches 14, improving the bendability, at suitable points along the distribution plate 8.

It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

LIST OF DESIGNATIONS

1 Moving blade
2 Rotation axis
3 Moving blade root
4 Blade airfoil
5 Cooling-air supply passage
6 Shoulder elements
61 Surface section
7 Opening
71 Opening margin
72 Cooling passage intermediate wall
8 Distribution plate
81 Through-opening
82, 83 End sections
9 Deflection elements
10 Marginal contour
11 Push-in slot
12 Closing plate
13 Recess
14 Notches

What is claimed is:

1. An arrangement for the admission of cooling air to the internal walls of a component configured to rotate about a rotation axis, comprising:

a component root which can be fastened to a rotor unit in a rotationally fixed manner and adjoining in a radially extending manner a component airfoil in which at least one cooling passage region extends radially longitudinally with respect to the rotation axis and in a region of the component root, opens via an opening into a cooling-air supply passage passing axially at least partly through the component root;

a distribution plate with through openings, wherein the distribution plate is provided in the cooling-air supply passage in such a way that during rotation of the component the distribution plate forms a fluid-tight connection with an opening, margin surrounding the opening of the at least one cooling passage region, the through openings being configured and arranged to conduct cooling air from the axial cooling-air supply passage into the radial cooling passage region; and the cooling air supply passage being formed with at least two axially spaced-apart shoulder elements each arranged radially opposite an opening margin and enclosing with the opening margin a push-in slot for receiving the distribution plate.

2. The arrangement as claimed in claim 1, wherein the component is produced by a casting process in which the cooling-air supply passage passing axially through the component root and the at least one cooling passage region oriented radially in the component airfoil is produced by a core technique.

3. The arrangement as claimed in claim 2, wherein the opening margin surrounding the opening is a surface region which encloses the opening and has a surface plane coinciding with an opening plane.

4. The arrangement as claimed in claim 1, wherein the opening margin surrounding the opening is a surface region which encloses the opening and has a surface plane coinciding with an opening plane.

5. The arrangement as claimed in claim 4, wherein at least two cooling passage regions are provided, the opening margins of which lie in a common surface plane, with which the distribution plate forms a fluid-tight connection at least during the rotation of the component about the rotation axis.

6. The arrangement as claimed in claim 4, wherein the opening plane of the opening is oriented perpendicularly to the radial direction predetermined by the rotation about the rotation axis.

7. The arrangement as claimed in claim 1, wherein the cooling-air supply passage passes axially completely through the component root, and the distribution plate can be pushed completely into the cooling-air supply passage at least on one side.

8. The arrangement as claimed in claim 7, wherein the distribution plate provides at least one bent-over end region in a state inserted in the cooling-air supply passage.

9. The arrangement as claimed in claim 1, wherein the distribution plate is made of a metallic material bent at its ends and including a flat portion facing the shoulder elements.

10. The arrangement as claimed in claim 1, wherein the distribution plate rests loosely on the shoulder elements, and a fluid-tight connection between the distribution plate and the opening margin is effected by a frictional connection which occurs due to centrifugal forces which are caused by the rotation and which act on the distribution plate.

11. The arrangement as claimed in claim 10, wherein the material and material thickness of the distribution plate are selected in such a way that the distribution plate conforms in a locally limited manner to a surface contour at least in the region of an opening margin.

12. The arrangement as claimed in claim 1, wherein the distribution plate is produced from a flat or round material.

13. The arrangement as claimed in claim 1, wherein the distribution plate is fixed against axial movement inside the cooling-air supply passage.

14. The arrangement of claim 13, wherein the distribution plate is fixedly joined by a brazed or welded joint.

15. The arrangement as claimed in claim 1, wherein the distribution plate has locally limited material weak points.

16. The arrangement as claimed in claim 15, wherein material weak points are designed as mechanical notches or cracks or by changing a structure in the distribution plate.

17. The arrangement as claimed in claim 1, wherein the cooling-air supply passage is closed off in a fluid-tight manner by a closing plate at least on one side.

18. The arrangement as claimed in claim 17, wherein the closing plate is welded or brazed to the component root after the distribution plate has been inserted into the cooling-air supply passage.

19. The arrangement as claimed in claim 1, wherein the component is a moving blade of a compressor or turbine stage in a steam or gas turbine plant.

20. The arrangement of claim 1, wherein the component airfoil is a one piece component.

* * * * *